US005123536A

United States Patent [19]

DiPietro

[11] Patent Number: 5,123,536

[45] Date of Patent: Jun. 23, 1992

[54] CARRIER FOR A FILM PACKAGE

[75] Inventor: Matthew DiPietro, Webster, N.Y.

[73] Assignee: Eastman Kodak Company, Rochester, N.Y.

[21] Appl. No.: 711,834

[22] Filed: Jun. 7, 1991

[51] Int. Cl.[5] ..... B65D 75/02

[52] U.S. Cl. ..... 206/455; 354/275

[58] Field of Search ..... 206/449, 451, 455, 456; 354/275; 378/174, 182, 184, 188

[56] References Cited

U.S. PATENT DOCUMENTS

| | | | |
|---|---|---|---|
| 948,901 | 2/1911 | Goldstein | 206/455 |
| 3,458,033 | 7/1969 | Ariyasu et al. | 206/455 |
| 3,898,680 | 8/1975 | Asano | 354/275 |
| 4,143,766 | 3/1979 | Goulde | 206/453 |
| 4,869,368 | 9/1989 | Hara | 206/455 |
| 4,915,229 | 4/1990 | Yamada et al. | 206/455 |

FOREIGN PATENT DOCUMENTS

| | | | |
|---|---|---|---|
| 0105937 | 4/1989 | Japan | 378/182 |

*Primary Examiner*—Jimmy G. Foster
*Attorney, Agent, or Firm*—Frank Pincelli

[57] ABSTRACT

A carrier is provided for a package containing a stack of film sheets enclosed by a bag. The carrier has a first wall positionable on one side of the stack of sheets and a second wall positionable on the opposite side of the stack of sheets. The carrier has an edge wall connected to the first wall and the second wall. The edge wall has an opening at the center portion thereof, and two spaced end portions separated by the opening. The carrier allows the stack of film sheets and the carrier to flex in the area of the opening in the carrier edge wall to reduce the tendency of the sheets to stick together and thereby improve reliability of feeding of the sheets seriatim from the stack.

3 Claims, 2 Drawing Sheets

CARRIER FOR A FILM PACKAGE

CROSS- REFERENCE TO RELATED APPLICATIONS

Reference is made to commonly assigned, copending U.S. Pat. application Ser. No. 07/703,937, entitled "Film Supply Magazine", filed on May 22, 1991 in the name of Matthew DiPietro.

BACKGROUND OF THE INVENTION

The present invention relates to a carrier for a package containing a stack of film sheets and, more particularly, to such a carrier for a stack of film sheets which are flexed to reduce the tendency of the sheets to stick together.

The related patent application mentioned above discloses a magazine having a space for receiving a package comprising a stack of film sheets enclosed within a bag or pouch of a flexible packaging material. The bag is removed while the package is within the magazine, and the magazine includes members which effect flexing of the film sheets in response to removal of the bag. This flexing of the sheets reduces the tendency of the sheets to stick together, thereby improving reliability of feeding of the sheets seriatim from the magazine and reducing the likelihood that multiple sheets will be fed simultaneously.

It is known to provide carriers in film packages containing rectangular sheets of x-ray film, for example. Carriers of this kind can be generally U-shaped or J-shaped with a first wall of the carrier being positionable on one side of the stack of sheets within a bag or pouch, and with a second wall of the carrier positionable on the opposite side of the stack of sheets. An edge wall integrally formed with the first wall and the second wall is positioned along a side edge of the stack of sheets and extends in a lateral direction the full width of the first and second walls. Carriers of this kind are known, for example, from U.S. Pat. No. 4,915,229, which issued Apr. 10, 1990 in the names of S. Yamada et al, and is entitled "Sheet Film Package and Buffer Sheet Member".

Carriers of the kind described above can be formed from thin bleached white stiffener board that is similar to cardboard. This material is difficult to bend when it is in a U or J shape as disclosed in U.S. Pat. No. 4,915,229. Also, the continuous, uninterrupted edge wall of prior carriers discourages flexing of the package. However, a package used with the magazine described in the before-mentioned, related patent application needs to flex as the bag is removed from the stack of film sheets. Thus conventional carriers make it difficult to achieve the desirable flexing of sheets in a package by the magazine of the copending application.

SUMMARY OF THE INVENTION

Accordingly, it is an object of the invention to provide an improved carrier for a film package containing a stack of sheets wherein the improved carrier facilitates bending of the stack of sheets while the sheets are within the carrier.

The invention relates to an improvement in a carrier for a package containing a stack of film sheets enclosed by a bag. The carrier has a first wall positionable on one side of the stack of sheets and a second wall positionable on the opposite side of the stack of sheets. The carrier and the stack of sheets are subject to a force which flexes the sheets to reduce the tendency of the sheets to stick together and thereby improve reliability of feeding of the sheets seriatim from the stack. The improvement of the invention comprises a carrier having an edge wall connected to the first wall and the second wall and adapted to be positioned along a side edge of the stack of sheets. The carrier edge wall has an opening at the center portion and two spaced end portions separated by the opening, thereby allowing the stack of film sheets and the carrier to flex in the area of the opening in the carrier edge wall.

The invention and its objects and advantages will become more apparent in the detailed description of the preferred embodiment of the invention presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Before proceeding with detailed description of the carrier of the invention, a package of the kind that the carrier can be used with will be generally described.

Figure 1:
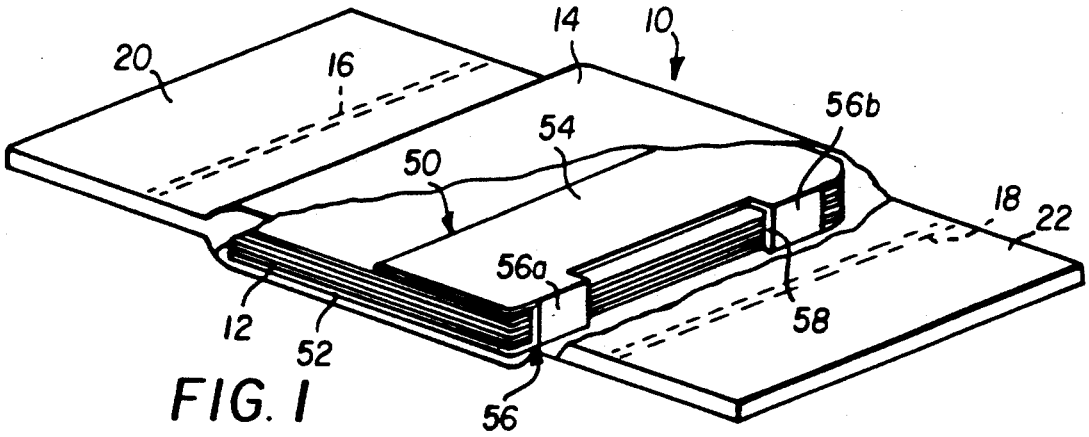
FIG. 1 is a perspective view, partially broken away, showing a package for film sheets that incorporates an improved carrier of the invention.

Referring now to FIG. 1 of the drawings, a package generally designated 10 is provided for holding a stack of film sheets 12 which are enclosed within a light-tight, flexible bag 14. Film sheets 12 may comprise sheets of x-ray film or laser print film , for example. Sheets 12 in a particular package 10 preferably are all of the same size, however, similar film packages 10 can contain film sheets of various sizes. The bag 14 can be formed from a flexible barrier wrap material which is placed around the stack of film sheets 12 and sealed to form a light-tight package. Sealing of the package can be accomplished by lines of heat sealing as shown at 16 and 18, and additional lines of heat sealing may be required, depending on the manner of forming the bag 14. Heat seal line 16 is formed in a leading end portion 20 of the bag, while heat seal line 18 is in a trailing end portion 22 of the bag. The bag may be formed under a vacuum so that the bag material clings tightly to the sheets 12, and the sheets tend to stick together. Packages 10 of the kind described above are known in the art.

Figure 2:
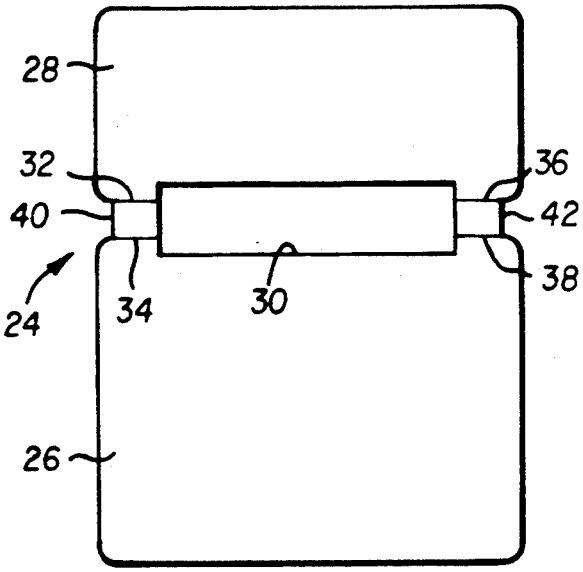
FIG. 2 is a plan view of a blank that is used for forming a carrier of the invention.

Referring now to FIG. 2 of the drawings, a blank or sheet as shown generally at 24 is used to form a carrier of the invention. Sheet 24 can be formed from materials of the kind known to be suitable for use as a carrier, such as a thin bleached white stiffener board. Sheet 24 has a shape that enables it to be folded into the carrier illustrated in FIGS. 1 and 3. More specifically, sheet 24 comprises a relatively large rectangular portion 26 which has a length and width that is substantially the same as the length and width of the sheets 12 that are to be positioned within the carrier. Sheet 24 has a second rectangular portion 28 that has a length substantially equal to the length of the sheets 12 and thus the same length as portion 26. However, the width of rectangular portion 28 is less than the width of the sheets 12, thereby leaving a portion of the sheets uncovered. A large rectangular opening 30 extends across the portion of sheet 24 between rectangular portions 26,28 and projects into the rectangular portions a short distance. Sheet 24 is creased or cut along lines 32, 34, 36 and 38 to define weakened areas which enable the sheet to be folded along these lines to form the carrier. The weakened end lines together with the opening 30 define two spaced connecting portions 40,42 between the rectangular portions 26,28. Connecting portions 40,42 have outer side edges that are offset inwardly from the outer side edges of the rectangular portions 26,28, thus forming recesses or notches in the area just outwardly from the connecting portions.

Figure 3:
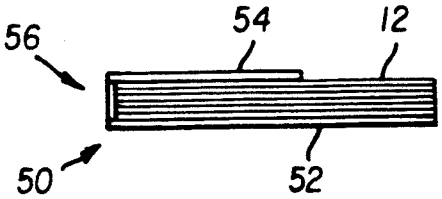
FIG. 3 is a side elevation view of the carrier formed from the blank of FIG. 2 and illustrating its position around a stack of film sheets.

A carrier of the invention, generally designated 50, is formed by bending the sheet 24 along lines 32, 34, 36 and 38 until portions 26,28 are in spaced, parallel planes, as shown in FIGS. 1 and 3. Carrier 50 has a first wall 52 formed from rectangular portion 26 which fits along the bottom side of the stack of sheets 12. A second wall 54 is formed from the rectangular portion 28 and it fits along the second, or upper, side of the stack of sheets. As indicated in FIGS. 1 and 3, wall 52 of the carrier is substantially the same length and width as the sheets 12, whereas wall 54 extends the full length of the sheet but not the full width of the sheet. Thus, when the bag 14 has been removed from the carrier and stack of sheets, a portion of the top sheet in the stack is not covered by the wall 54 and thus is available for engagement by a sheet feeding mechanism for removal of the sheets seriatim from the stack.

Figure 4:
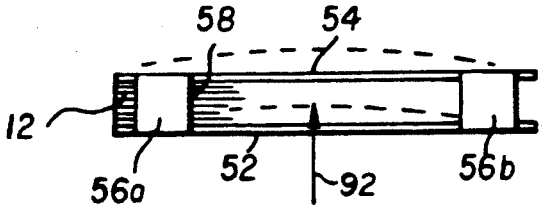
FIG. 4 is an elevation view of the carrier and stack of sheets taken from the left side of FIG. 3 illustrating movement of the sheets and carrier in response to flexing thereof.

The carrier has an edge wall generally designated 56 which fits along one side edge of the stack of sheets. Edge wall 56 comprises two spaced end portions **56*a*,56*b* (FIGS. 1 and 4). End portions 56*a*,56*b* are separated by an opening 58 formed by part of the opening 30 in the sheet 24. Carrier edge wall 56 is shorter than the adjacent portions of the first and second walls, as shown in FIGS. 1 and 4, so that the outer portions of the end portions 56*a*,56*b* of the edge wall are spaced inwardly from the outer edges of the stack of sheets 12. Also, opening 58 in the edge wall 56 extends into the lower wall 52 and the upper wall 54, as illustrated in FIG. 1. This opening 58** in all three walls of the carrier provides a weakened area which enables the carrier and the film sheets carried thereby to be flexed easily to reduce the tendency of the sheets to stick together, and thereby improve the reliability of feeding of the sheets seriatim from the stack. This flexing of the sheets can be achieved by manually flexing the stack before it is loaded into a machine or magazine.

Figure 5:
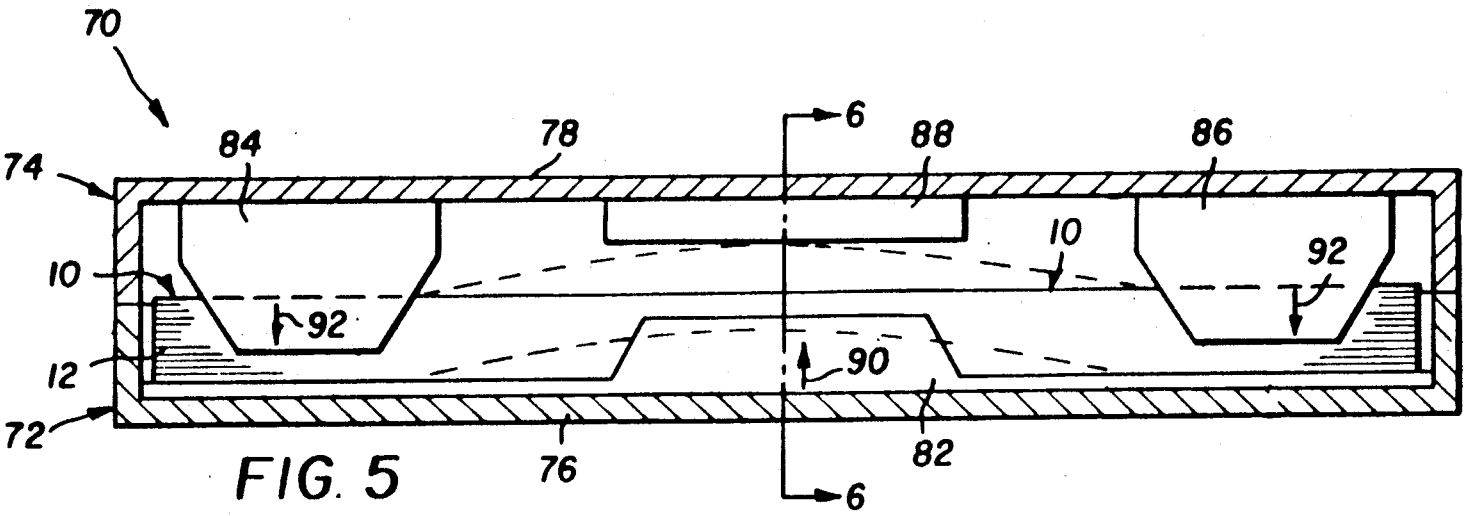
FIG. 5 is a transverse cross section through a magazine of the kind disclosed in the related application referenced above, and illustrating apparatus in the magazine for bending a film package.
Figure 6:
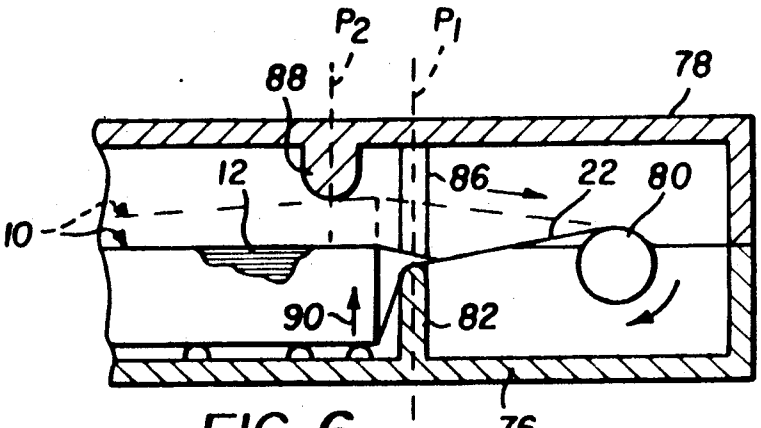
FIG. 6 is a fragmentary cross section taken along lines 6—6 of FIG. 5, further illustrating the magazine of FIG. 5 and removal of the packaging material to effect flexing of the stack of sheets and carrier.

In the before-mentioned related patent application, means are provided in a magazine for automatically flexing the package in response to removal of the bag 14 from the package. FIGS. 5 and 6 illustrate portions of the magazine of such copending application, which will help facilitate an understanding of the manner in which the film sheets can be flexed in the magazine.

The magazine of FIGS. 5 and 6 is generally designated 70 and comprises a lower portion 72 and an upper portion 74 that are secured together by a hinge (not shown) to enable portion 34 to be raised and lowered for opening and closing the magazine. There is a space within the magazine for receiving a film package 10 so that it rests on a bottom 76 of the magazine and under a cover 78. A spindle 80 (FIG. 6) in one end portion of the magazine receives the end portion 22 of the film package and is rotated in the direction indicated by the arrow for removing the bag 14 from the stack of sheets 12. Before the spindle is rotated, the bag 14 is cut between the heat seal line 16 and the adjacent end of the stack of sheets 12.

A stop 82 projects upwardly from the bottom 76 and is located between the spindle 80 and the film package 10. Two additional stops 84,86 project downwardly from the cover 78 and also are located between the spindle 80 and the package 10. Stops 82, 84 and 86 are located in a common plane $P_1$ (FIG. 6) and the top edge of stop 82 is above the lower edge of the stops 84,86. A fourth stop 88 projects downwardly from the cover 78 in a second plane $P_2$ that is offset from the plane $P_1$. The lower edge of stop 88 is spaced from the top of package 10 when the package is placed in the magazine and before the spindle 80 is rotated to remove the bag from the stack of sheets.

Stops 82,88 are in the center portion of the magazine, as viewed in FIG. 5, while stops 84,86 are near, but spaced from, the side walls of the magazine. When the spindle 80 is rotated, the portion 22 of the package is pulled above stop 82 and below stops 84, 86 and 88. This produces an upward component of force shown by the arrow 90 in the center portion of the package, and downward components of force, as shown at 92 at the side edges of the package, which hold the side edges downwardly. The result is an upward flexing of the package as shown in dotted lines in FIGS. 4 and 5. This flexing of the package occurs in the center portion of the package in the area of the opening 58 in the carrier. This flexing of the sheets 12 overcomes the tendency of the sheets to stick to each other, thus loosening and separating the sheets relative to each other. This increases the reliability in feeding sheets seriatim from the stack after the bag has been removed, and reduces the likelihood of inadvertently feeding two or more sheets at a time from the stack.

The carrier 50 of the invention facilitates this flexing action of the package and the stack of sheets therein by providing a weakened area in the edge wall 56 and the adjacent portions of the side walls 52,54. This weakened area is formed by the opening 58 that extends across a major portion of the edge wall 56 and into the adjacent side walls 52,54.

Among the advantages achieved by the carrier of the invention is the enhanced flexing of a stack of sheets within a film package This flexing increases the reliability of sheet feeding by overcoming the tendency of a stack of film sheets to stick to each other, especially when they have been loaded under vacuum in a package that is air tight. Improved flexing of the package results whether the package is flexed by hand by an operator or as a result of removing of the bag from the stack of sheets in a magazine of the kind described in the before-mentioned related patent application. The carrier is especially advantageous when used in a package that is positioned within a magazine because it facilitates flexing of the center portion of the stack of sheets and thus reduced the force required for rotation of the spindle 80 and removal of the bag from the stack of sheets.

The invention has been described in detail with particular reference to a preferred embodiment thereof, but it will be understood that variations and modifications can be effected within the spirit and scope of the invention.

I claim:

1. In a carrier for a package containing a stack of film sheets enclosed by a bag, the carrier having a first wall positionable on one side of the stack of sheets and a second wall positionable on the opposite side of the stack of sheets, the carrier and the stack of sheets being subject to a force which flexes the sheets to reduce the tendency of the sheets to stick together and thereby improve reliability of feeding of the sheets seriatim from the stack, the improvement comprising:

the carrier having an edge wall connected to the first wall and the second wall and adapted to be positioned along a side edge of the stack of sheets, the carrier edge wall having an opening at the center portion thereof and two spaced end portions separated by the opening which forms a weakened area in said first and second walls, thereby allowing the stack of film sheets and the carrier to flex in the area of the opening in the carrier edge wall.

2. A carrier as set forth in claim 1, wherein the opening in the carrier extends into the first wall and the second wall of the carrier.

3. A carrier as set forth in claim 1 wherein the carrier edge wall is shorter than the adjacent portions of the first and second walls with the end portions of the carrier edge wall having outer edges that are spaced inwardly from the outer edges of the first and second walls.

* * * * *